US006799641B1

(12) United States Patent
Lyon et al.

(10) Patent No.: US 6,799,641 B1
(45) Date of Patent: Oct. 5, 2004

(54) PERCUSSIVE DRILL WITH ADJUSTABLE FLOW CONTROL

(75) Inventors: Leland H. Lyon, Roanoke, VA (US); Warren Thomas Lay, Catawba, VA (US); Jeffrey P. White, Vinton, VA (US)

(73) Assignee: Atlas Copco AB, Fagersta (SE)

( * ) Notice: Subject to any disclaimer, the term of this patent is extended or adjusted under 35 U.S.C. 154(b) by 0 days.

(21) Appl. No.: 10/600,470

(22) Filed: Jun. 20, 2003

(51) Int. Cl.[7] ..... B23Q 5/033
(52) U.S. Cl. ..... 173/17; 173/91; 173/206
(58) Field of Search ..... 173/17, 78, 91, 173/135, 138, 139, 168, 206; 175/92, 296

(56) References Cited

U.S. PATENT DOCUMENTS 3,193,024 A * 7/1965 Cleary ..... 173/17
4,913,243 A * 4/1990 Jenne et al. ..... 175/57
5,193,627 A * 3/1993 Jenne ..... 175/19
5,337,837 A * 8/1994 Wentworth et al. ..... 175/19
5,488,998 A * 2/1996 Ekwall et al. ..... 173/91
5,494,116 A * 2/1996 Wentworth ..... 173/17
5,944,117 A * 8/1999 Burkholder et al. ..... 173/91
6,135,216 A * 10/2000 Lyon et al. ..... 175/296

* cited by examiner

*Primary Examiner*—Scott A. Smith
*Assistant Examiner*—Chukwurah Nathaniel
(74) *Attorney, Agent, or Firm*—Michael Best & Friedrich LLP

(57) ABSTRACT

A fluid channeling device is for a percussive drill including a casing having an interior space, drive and valve chambers defined within the interior space, a piston disposed within the casing and having an upper end disposeable within the drive chamber and a longitudinal through-bore, and a valve for controlling flow into the drive chamber. The device includes a first member partially disposed within the drive chamber so as to extend into the piston bore when the piston end is within the drive chamber. The first member has an outer surface, an interior space and one or more ports extending between the outer surface and interior space and fluidly connectable with the drive chamber. A second member is disposed within the first member interior and has a passage fluidly connected with the valve chamber and fluidly connectable with the port(s) to establish fluid communication between the drive and valve chambers.

20 Claims, 8 Drawing Sheets

PERCUSSIVE DRILL WITH ADJUSTABLE FLOW CONTROL

BACKGROUND OF THE INVENTION

The present invention relates to percussive drill assemblies, and particularly to components used to direct high-pressure fluid within drill assemblies including a fluid-operated piston.

One type of commercial percussive drill, commonly referred to as a "down-hole" drill due to its intended application, is typically operated by high pressure fluid (e.g., compressed air) that is appropriately directed in order to reciprocate a piston to repetitively impact against a drill bit, the bit having a cutting surface used to cut or bore through materials such as earth and stone. These fluid-operated drills generally have a drive chamber into which the high pressure fluid is directed in order to drive the piston from an initial position to impact the bit. Further, a valve is typically provided to control the flow of percussive fluid into the chamber.

SUMMARY OF THE INVENTION

In a first aspect, the present invention is a fluid channeling device for a percussive drill. The drill includes a casing having an interior space, a drive chamber and a valve chamber each being defined within the casing interior space, a piston movably disposed within the casing and having an upper end disposeable within the drive chamber and a longitudinal through-bore, and a valve configured to control flow into the drive chamber and having a surface bounding a section of the valve chamber. The channeling device comprises a first member disposed at least partially within the drive chamber so as to extend into the piston bore when the piston upper end is located within the drive chamber. The first member has an outer surface, an interior space and at least one port extending between the outer surface and the interior space and fluidly connectable with the drive chamber. A second member is disposed at least partially within the first member interior space and has a passage. The passage is fluidly connected with the valve chamber and fluidly connectable with the port so as to establish fluid communication between the drive chamber and the valve chamber.

In another aspect, the present invention is again a fluid channeling device for a percussive drill. The drill includes a casing having an interior space, a drive chamber and a valve chamber each being defined within the casing interior space, a piston movably disposed within the casing and having an upper end disposeable within the drive chamber and a longitudinal through-bore, and a valve configured to control flow into the drive chamber and having a surface bounding a section of the valve chamber. The channeling device comprises a generally tubular body disposed at least partially within the drive chamber so as to extend into the piston bore when the piston upper end is located within the drive chamber. The tubular body has outer and inner circumferential surfaces and a plurality of ports, each port extending between two surfaces and fluidly connectable with the drive chamber. A generally cylindrical body is disposed at least partially within the tubular body and has a passage fluidly connected with the valve chamber. At least one of the tubular body and the cylindrical body is angularly displaceable with respect to the other one of the tubular body and the cylindrical body. As such, each one of the ports is fluidly connectable with the passage at a separate angular position of the tubular body with respect to the cylindrical body so as to establish fluid communication between the drive chamber and the valve chamber.

In a further aspect, the present invention is a drill comprising a casing having an interior space, a drive chamber and a valve chamber each being defined within the casing interior space. A piston is movably disposed within the casing and has an upper end disposeable within the drive chamber and a longitudinal through-bore. A valve is configured to control flow into the drive chamber and having a surface bounding a section of the valve chamber. Further, a first member is disposed at least partially within the drive chamber so as to extend into the piston bore when the piston upper end is located within the drive chamber. The first member has an outer surface, an interior space and at least one port extending between the outer surface and the interior space and fluidly connectable with the drive chamber. Furthermore, a second member is disposed at least partially within the first member interior space and has a passage fluidly connected with the valve chamber and fluidly connectable with the port so as to establish fluid communication between the drive chamber and the valve chamber.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
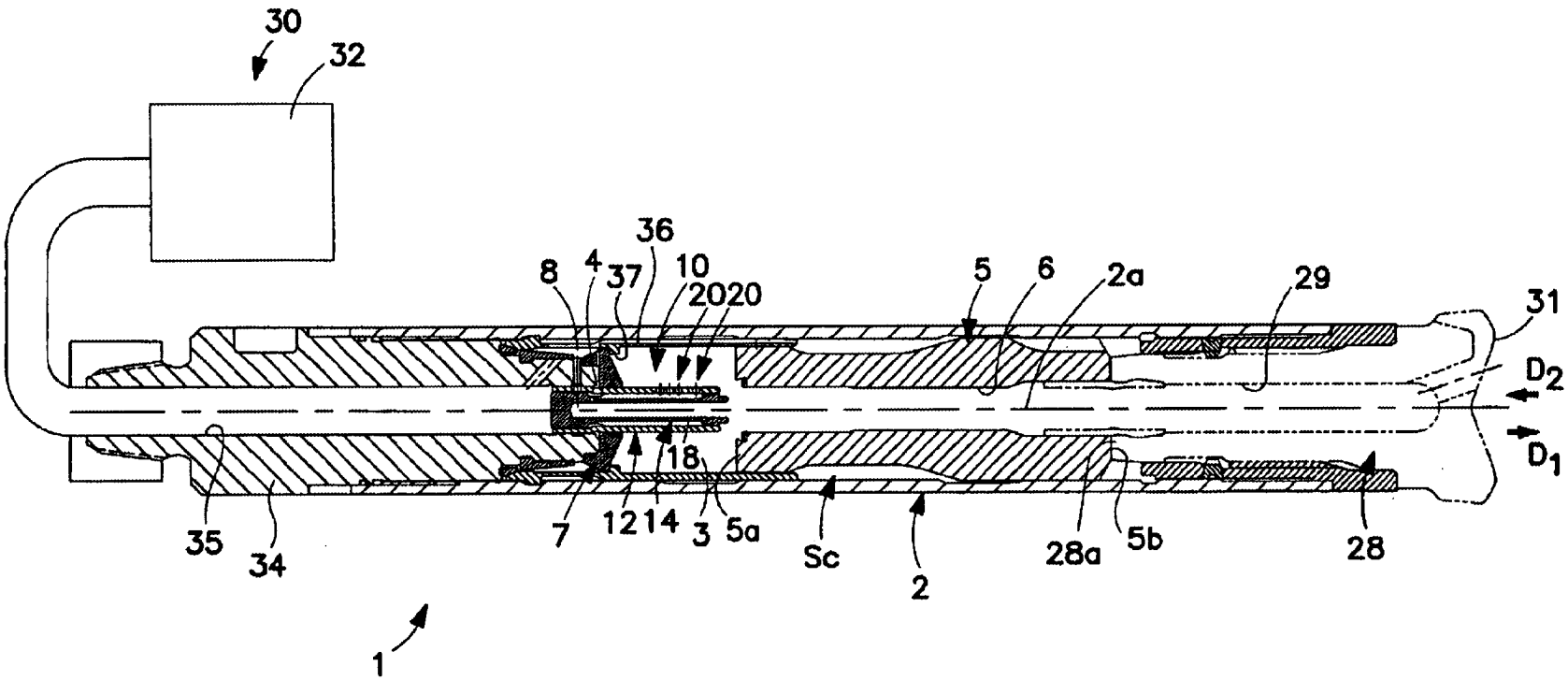
FIG. 1 is an axial cross-sectional view of a percussive drill having a fluid channeling device in accordance with the present invention.

Certain terminology is used in the following description for convenience only and is not limiting. The words "upper", "upward", and "lower", "downwards refer to directions toward and away from, respectively, a designated upper end of a drill or a component thereof. The words "inner" and "outer", "outward" refer to directions toward and away from, respectively, the geometric center of the drill, of a fluid channeling device or a component of either, or toward and away from, respectively, the drill centerline, the particular meaning intended being readily apparent from the context of the description. The terms "radial" and "radially-extending" refer to directions generally perpendicular to a designated centerline or axis, and refer both to elements that are either partially or completely oriented in a radial direction. The terminology includes the words specifically mentioned above, derivatives thereof, and words or similar import.

Referring now to the drawings in detail, wherein like numbers are used to indicate like elements throughout, there is shown in FIGS. 1–17 a presently preferred embodiment of a fluid channeling device 10 for a percussive drill 1. The channeling device 10 is preferably used with a drill 1 that includes a casing 2 having an interior space $S_c$, a drive chamber 3 and a valve chamber 4 each defined within the casing interior space $S_c$, and a piston 5 movably disposed within the casing 2. The piston has an upper end 5*a* disposeable within the drive chamber 3 and a longitudinal through-bore 6. Further, the drill 1 also preferably includes a valve 7 configured to control flow into the drive chamber 3 and having a surface 7*a* bounding a section of the valve chamber 4. However, the fluid channeling device 10 may be used with any other appropriate type of drill 1, as discussed below.

Basically, the channeling device 10 comprises a first, outer member 12, a second, inner member 14 disposed at least partially within the first member 12 and a central axis 11 extending longitudinally through the first and second members 12, 14. The first member 12 is disposed at least partially within the drive chamber 3, so as to extend into the piston bore 6 when the piston upper end 5*a* is located within the drive chamber 3 (see e.g., FIG. 2). Further, the first member 12 has an outer surface 16, an interior space 18 and at least one inlet or control port 20 extending between the outer surface 16 and the interior space 18. The control port(s) 20 are each fluidly connectable with the drive chamber 3, specifically when the piston 5 is located relative to the fluid channeling device 10 such that the port 20 is disposed externally of the piston bore 6, to thereby enable fluid flow from the drive chamber 3 and into the first member interior space 18. Preferably, the first member 12 includes or is formed as a tubular body 22, most preferably as a circular tubular body 22, but may be formed in any other appropriate manner as described below. The second, inner member 14 preferably includes or is formed as a generally cylindrical body or body portion 24, and most preferably as a generally circular cylindrical body 24, sized to fit within the first member tubular body 22 so as to be disposed at least partially within the interior space 18 of the first member 12. The second member 14 has a flow passage 26 fluidly connected with the valve chamber 4 and fluidly connectable with the control port(s) 20 so as to establish fluid communication between the drive chamber 3 and the valve chamber 4, in order to induce closure of the valve 7 as discussed below.

Figure 6:
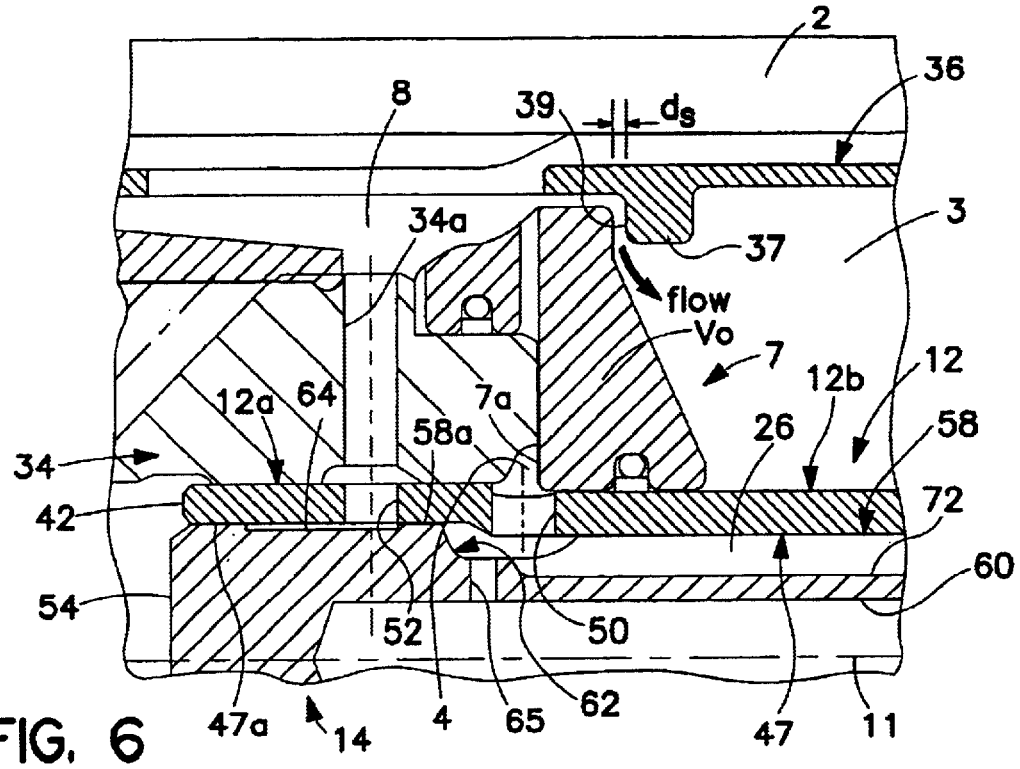
FIG. 6 is a greatly enlarged, broken-away axial cross-sectional view of the drill, showing a valve in an open position.
Figure 7:
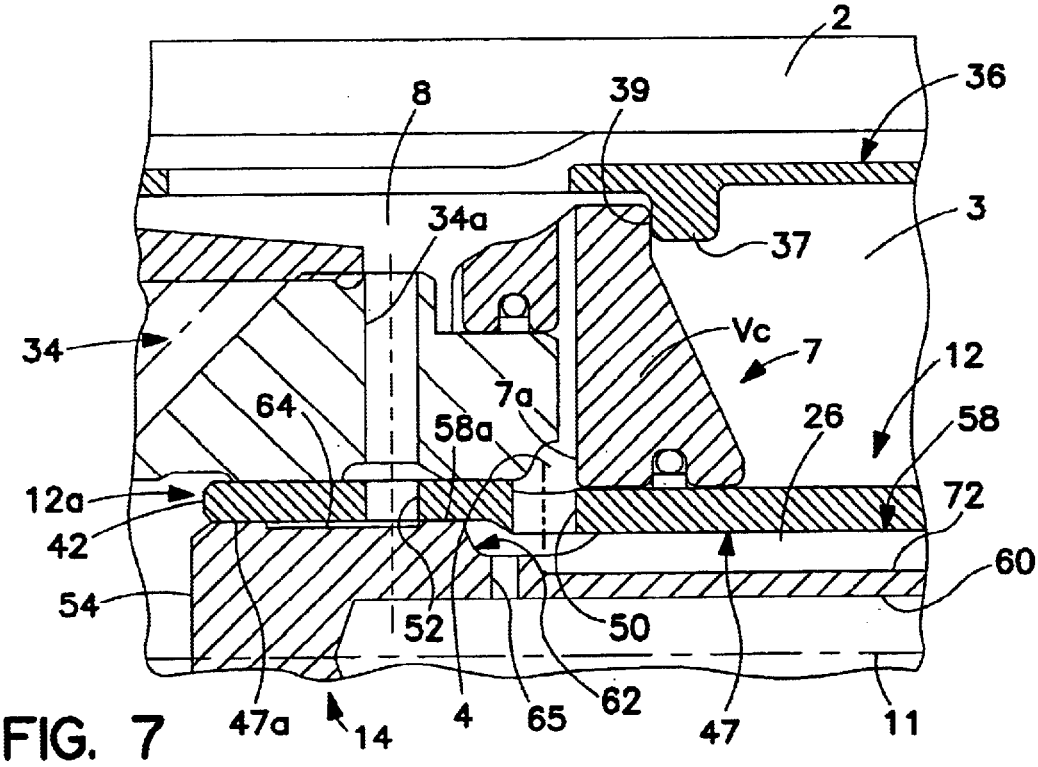
FIG. 7 is another view of the drill of FIG. 6, showing the valve in a closed position.

Preferably, the valve 7 is displaceable between an open position $V_o$ (FIG. 6) and a closed position $V_c$ (FIG. 7). In the open position $V_o$, fluid flows from a supply chamber 8 (described below) of the drill 1 and into the drive chamber 3 so as to exert pressure against the piston upper end 5*a* to drive the piston 5 downwardly toward a bit 28 (described below). In the closed position $v_c$, the valve 7 interrupts or substantially prevents flow from the supply chamber 8 to the drive chamber 3, thereby "cutting off" fluid flow to the piston 5. When the first member port 20 and the second member passage 26 fluidly connect the drive chamber 3 with the valve chamber 4, fluid flows from the drive chamber 3 and into the valve chamber 4 and exerts pressure against the valve surface 7*a*. Such pressure displaces the valve 7 from the open position $V_o$ to the closed position $v_c$ in a generally similar manner as described with the closure of the "pressure sensitive valve 42" disclosed in U.S. Pat. No. 5,301,761, which is incorporated by reference herein. Thus, the fluid channeling device 10 basically functions as a valve closure device, but may have other appropriate applications, as discussed below.

Preferably, at least one of the first member 12 and the second member 14 is angularly displaceable about the central axis 11 with respect to the other one of two members 14 and 12. As such, the two members 12, 14 are positionable relative to each other in a variety of different angular orientations or positions $A_n$ with respect to the axis 11 so as to adjust the position of the control port(s) 20 with respect to the flow passage 26. Further, the first member 12 most preferably includes a plurality of the control ports 20 each extending between the interior space 18 and the first member outer surface 16 and located such that each one of the ports 20 is spaced apart axially and radially about the central axis 11 from each of the other ports 20. Furthermore, each control port 20 is fluidly connectable with the flow passage 26 at a separate one of the plurality of angular positions $A_n$ of the second member 14 with respect to the first member 12 (and/or vice-versa).

In other words, a first port 21A is fluidly connected with the passage 26 in a first angular position Al (FIGS. 8 and 12), a second port 21B is fluidly connected with the passage 26 in a second angular position $A_2$ (FIGS. 9 and 13), etc., as discussed in further detail below. With this structure, the "timing" or the point in the piston displacement cycle (described below) at which closure of the valve 7 occurs is variable or adjustable. By providing the capability of varying the time of valve closure, the fluid channeling device 10 enables the drill 1 to be adapted for optimal performance with each one of a plurality of fluid supplies 30 of different (i.e., greater or lesser) pressure capacities, as described below. Having discussed the basic elements and operation of the present invention, the fluid channeling device 10 and the components thereof are described in greater detail below.

In order to appreciate the full benefits of the fluid channeling device 10, it is first necessary to describe certain features of the structure and operation of the preferred percussive drill 1, as follows. As best shown in FIG. 1, the drill 1 further includes a bit 28 having a central bore 29 and a lower cutting surface 31 that performs the work of the drill 1, such drilling or cutting work being driven by energy transmitted from impacts of the piston 5 onto the upper end 28*a* of the bit 28, as discussed below. A source or supply 30 of a relatively high pressure fluid, most preferably a compressor 32 for supplying compressed air, is fluidly connected with a backhead 34 attached to the upper end of the casing 2. Pressurized fluid flows from the supply 30 into a central bore 35 of the backhead 34 and is directed to the supply chamber 8. Preferably, the backhead 34 also functions to position and retain the fluid channeling device 10 disposed within the casing 2, as described below. Further, the drill 1 also preferably includes a generally tubular fluid distributor 36 disposed within the casing 2 and having a central passage 37 fluidly connecting the supply chamber 8 with the drive chamber 3. The valve 7 is configured to control flow through the central passage 37, the valve 7 being disposed generally against a valve seat surface 39 of the distributor 36 in the closed position $V_c$ (FIG. 7) and being generally spaced a distance $d_s$ from the distributor seat surface 39 in the open position $V_o$ (FIG. 6).

Figure 2:
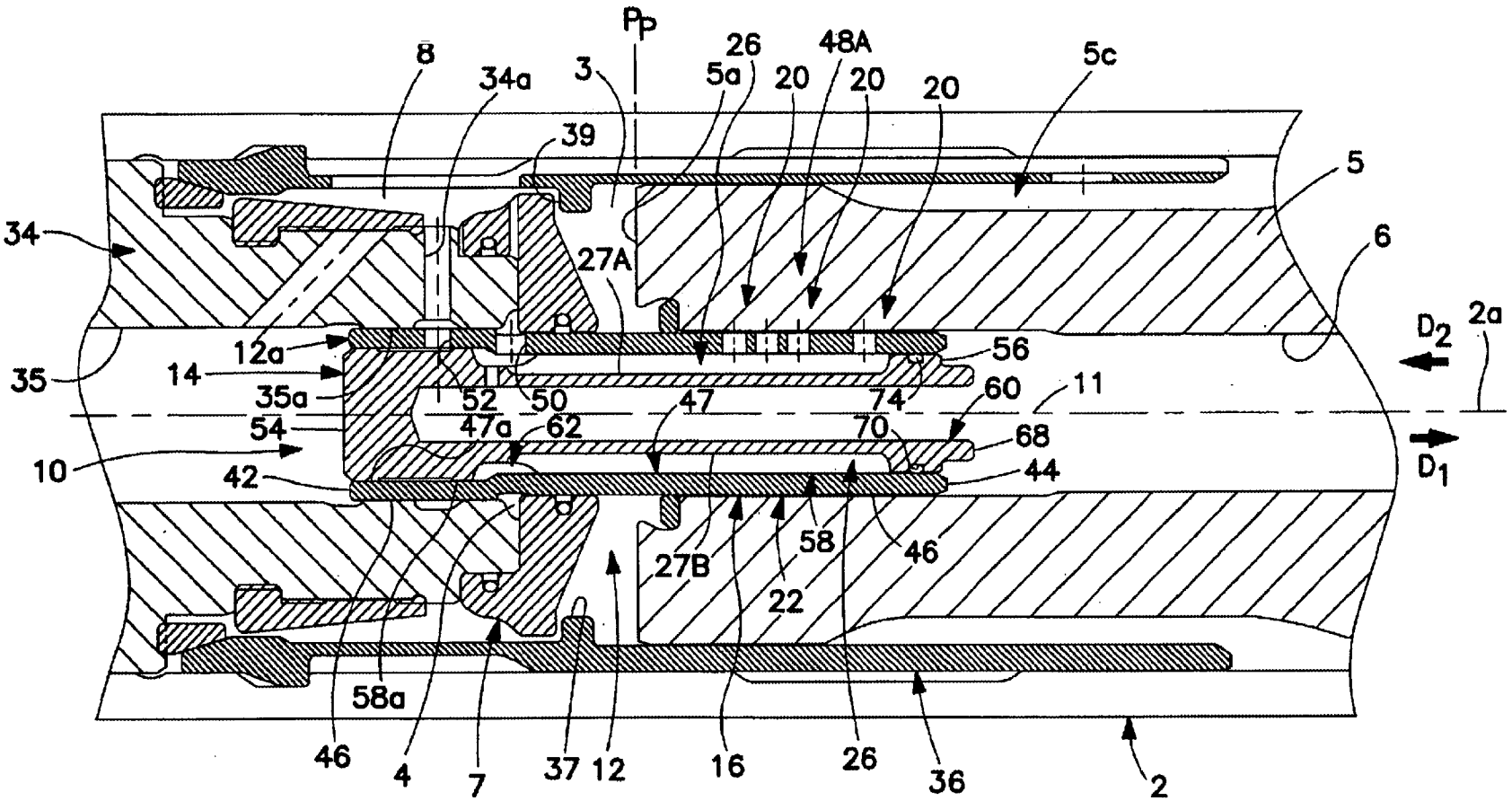
FIG. 2 is an enlarged, broken-away axial cross-sectional view of the percussive drill, showing a piston in a first, drive position and the channeling device with a single set of ports, the ports being depicted axially aligned for convenience of illustration only.
Figure 3:
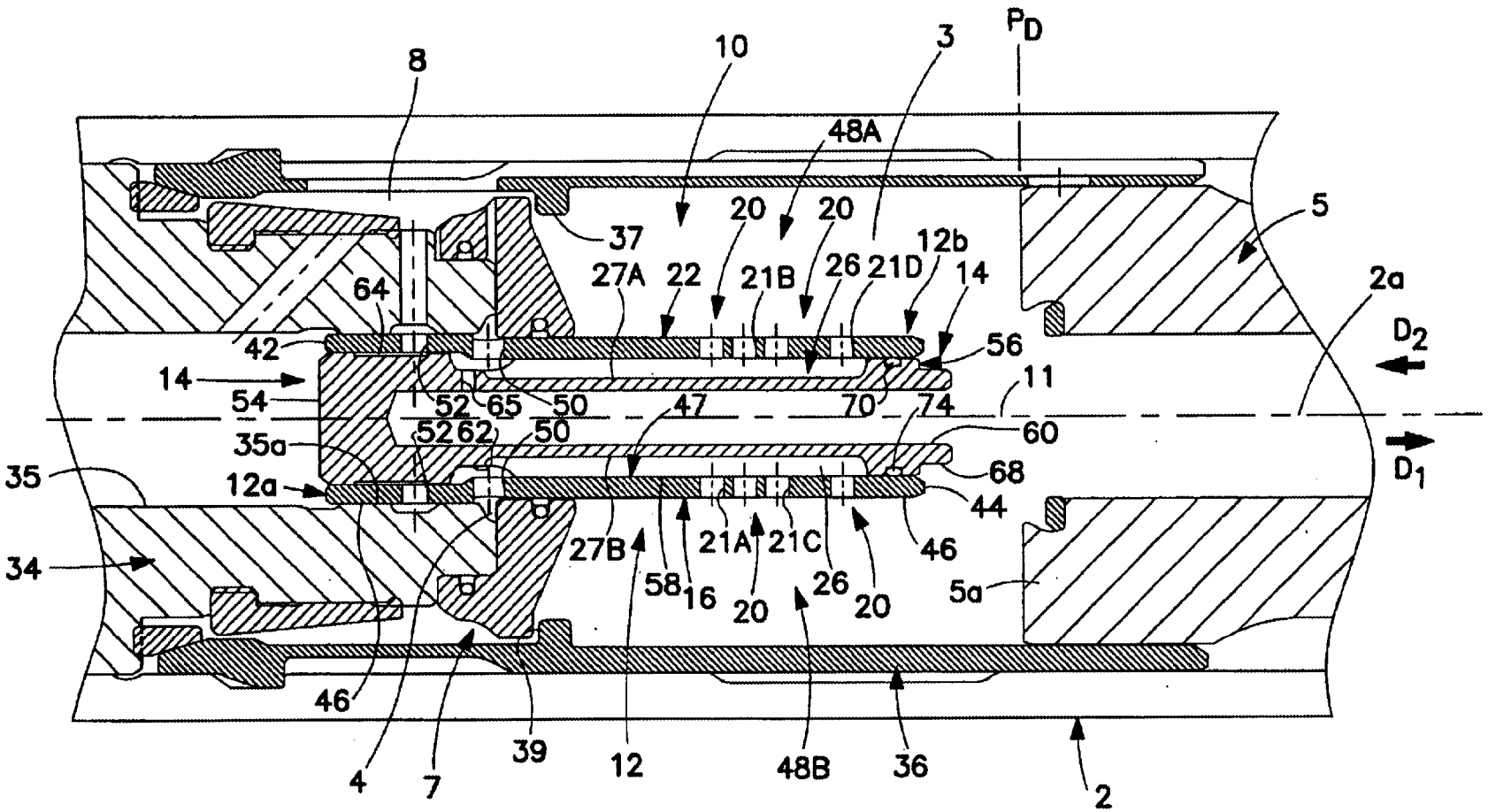
FIG. 3 is another view of the drill of FIG. 2, showing the piston in a second, impact position and the channeling device with two sets of ports, the ports again being depicted axially aligned for convenience of illustration only.

Furthermore, the drill casing 2 has a centerline 2*a* and the piston 5 is reciprocally displaceable generally along the centerline 2*a* in opposing directions $D_1$, $D_2$ between a first, "drive" position (FIG. 2) and a second, "impact" position (FIGS. 1 and 3). In the drive position shown in FIG. 2, the piston 5 is spaced a greatest distance (not indicated) from the bit 28 and is located at a most proximal position $P_P$ with respect to the valve chamber 4. Further, the piston upper end 5*a* is disposed generally completely within the drive chamber 3 and the first member 12 is disposed at least partially within the piston bore 6. In the impact position shown in FIGS. 1 and 3, the piston lower end 5*b* impacts the bit 28 with a relatively substantial kinetic energy to drive the bit cutting surface 31 into a work surface (not shown) and is located at a most distal position $P_D$ with respect to the valve chamber 4. As such, the piston upper end 5*a* is disposed externally of the drive chamber 3 and the first member 12 is spaced apart from the piston 12 along the centerline 2*a*. While the piston 5 displaces along the centerline 2*a* in the first direction $D_1$ from the drive position and toward the impact position, the piston 5 substantially prevents fluid communication between the drive chamber 3 and the port 20 aligned with the flow passage 26 for as long as the port 20 remains disposed within the piston bore 6. Thereafter, when the port 20 becomes disposed externally of the piston bore 6, the port 20 is fluidly connected with the drive chamber 3 so as to connect the drive chamber 3 with the valve chamber 4, as discussed above and in further detail below.

Referring now to FIGS. 1–4 and 6–17, the tubular body 22 of the first member 12 has a first, upper radial end.42, a second, lower radial end 44 spaced from the first end 42 along the central axis 11, an outer circumferential surface 46 providing the member outer surface 16 and an opposing inner circumferential surface 47 bounding the first member interior space 18. Each circumferential surface 46 and 47 is configured to frictionally engage with mating surfaces of the backhead 34 and the second member 14, respectively. Specifically, the fluid channeling device 10 is preferably retained within the drill casing 2 by inserting the first member 12 at least partially through the backhead bore 35 such that a first, upper portion 12*a* of the first member 12 is disposed within the bore 35 and a second, lower portion 12*b* extends into, and is disposed within, the drive chamber 3. At least an upper portion of the outer first member circumferential surface 46 is preferably conical or tapering so as to "wedges" within a tapering inner circumferential surface section 35*a* of the distributor bore 35, thereby frictionally retaining the first member 12 within the backhead 34, as best shown in FIGS. 2 and 3. When so installed within the backhead 34, the central axis 11 of the channeling device 10 is preferably generally collinear with the casing centerline 2*a*.

In addition to the one or more control ports 20, as described in further detail below, the first member 12 preferably includes at least one and most preferably two outlet ports 50 each extending between the outer circumferential surface 46 and the interior space 18. The outlet ports 50 are preferably radially spaced apart from each other by about 180 degrees about the central axis 11 (see, e.g., FIG. 3) and are disposed generally proximal to the body upper end 42, so as to be spaced axially apart from the inlet port(s) 20, as best shown in FIGS. 2 and 3. Further, each outlet port 50 is fluidly connected with the valve chamber 4 and with the second member passage(s) 16, as discussed below. Preferably, the first member 12 also further includes at least one and most preferably two bypass ports 52 extending generally radially between the outer and inner surfaces 46, 47 and disposed generally between the outlet ports 50 and the body first end 42. The bypass ports 52 are fluidly connectable with a central bore 60 of the second member 14 through one or more radial bypass passages (none shown) that may be optionally provided in the second member 14, a detailed description of bypass system being beyond the scope of the present disclosure.

Figure 4:
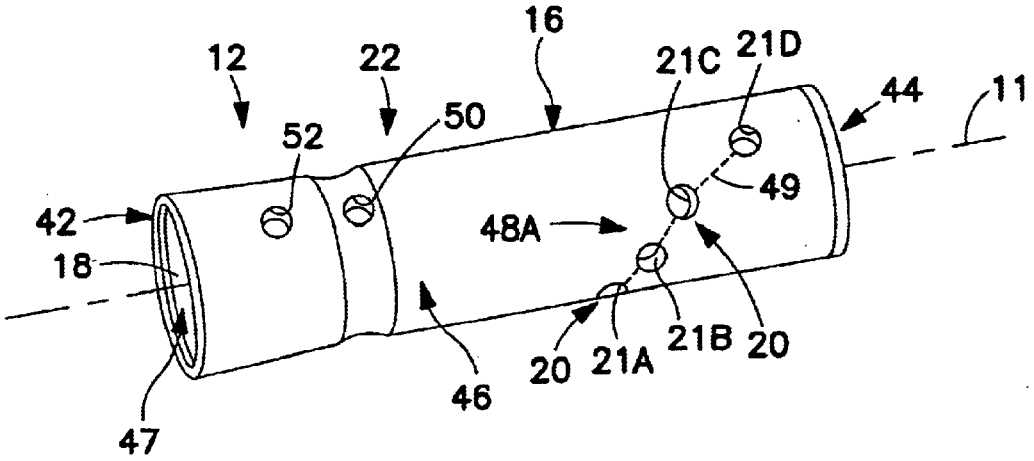
FIG. 4 is a side perspective view of a first, outer member of the channeling device.
Figure 5:
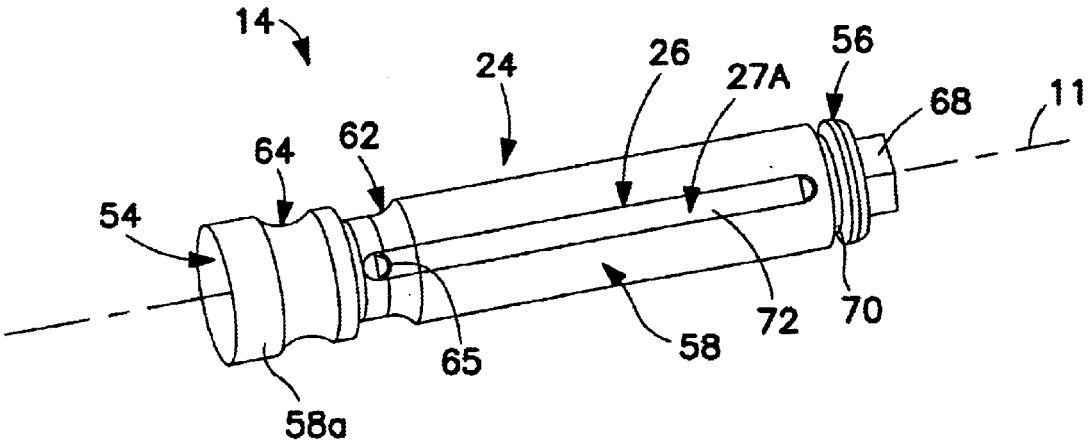
FIG. 5 is a side perspective view of a second, inner member of the channeling device.
Figure 8:
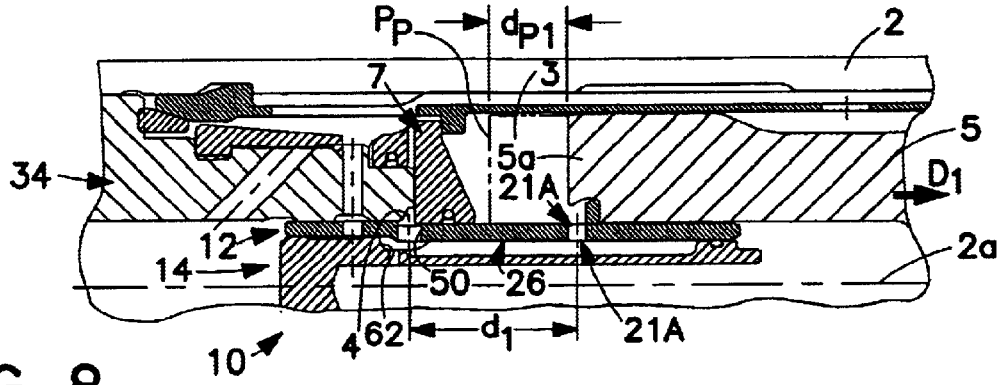
FIG. 8 is an enlarged, broken-away axial cross-sectional view of the drill, showing a first port of the first member fluidly connected with a flow passage of the second member.
Figure 9:
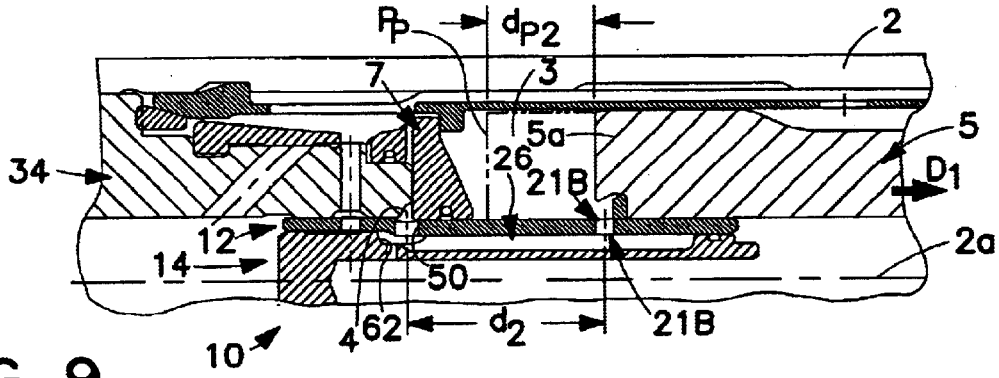
FIG. 9 is another view of the drill of FIG. 8, showing a second port of the first member fluidly connected with the second member flow passage.

As discussed above, the first member 12 preferably includes at least two inlet or control ports 20, specifically a first port 21A and a second port 21B, each port 21A and 21B being disposed generally proximal to the body second end 44. The first port 21A is spaced a first distance $d_1$ (FIG. 8) from the valve chamber 4 and the second port 21B is spaced a second distance $d_2$ (FIG. 9) from the valve chamber 4, the second distance $d_2$ being greater than the first distance $d_1$. With this structure, when the first port 21A is radially aligned with the flow passage 26, so as to be fluidly connected therewith, the valve 7 moves to the closed position $v_c$ after the piston 5 displaces by about a first distance $d_{P1}$ from the proximal position $P_P$ in the first direction $D_1$, as shown in FIG. 8. Alternatively, when the second port 21B is fluidly connected with the flow passage 26, the valve 7 moves to the closed position $V_c$ after the piston 5 displaces by about a second distance $d_{P2}$ from the proximal position $P_P$ in the first direction $D_1$, as depicted in FIG. 9. The second displacement distance $d_{P2}$ is greater than the first displacement distance $d_{P2}$, such that the valve 7 closes at an earlier point in the downward movement of the piston 5 when the first port 21A is connected with the passage 26 as compared to the point in the piston displacement at which the valve 7 closes when the second port 21B is connected with the passage 26. Most preferably, the first member 12 includes two port sets 48A, 48B of four ports 20 each, each port set 48A, 48B being fluidly connectable or alignable with a separate one of two preferred flow passages 26, as described below. Each port set 48A, 48B includes one first port 21A and one second port 21B, as described above, and preferably also has a third port 21C and a fourth port 21D. Each third port 21C is spaced a third distance $d_3$ (FIG. 10) from the valve chamber 4 and each fourth port 21D is spaced a fourth distance $d_4$ (FIG. 11) from the valve chamber 4, the third distance $d_3$ being greater than each of the first and second distances $d_1$, $d_2$, respectively, and the fourth distance $d_4$ being greater than each of the respective first, second and third distances $d_1$, $d_2$ and $d_3$. Preferably, the four ports 21A, 21B, 21C and 21D of each port set 48A, 48B are spaced apart along a separate generally helical line 49 (only one indicated), each line 49 extending at least partially circumferentially about and axially along the central axis 11, as depicted in FIG. 4. Further, the two port sets 48A and 48B are arranged such that the two corresponding ports of each set 48A, 48B (e.g., the two first ports 21A) are each simultaneously radially aligned with the associated passage 26, as best shown in FIGS. 12–15.

Figure 10:
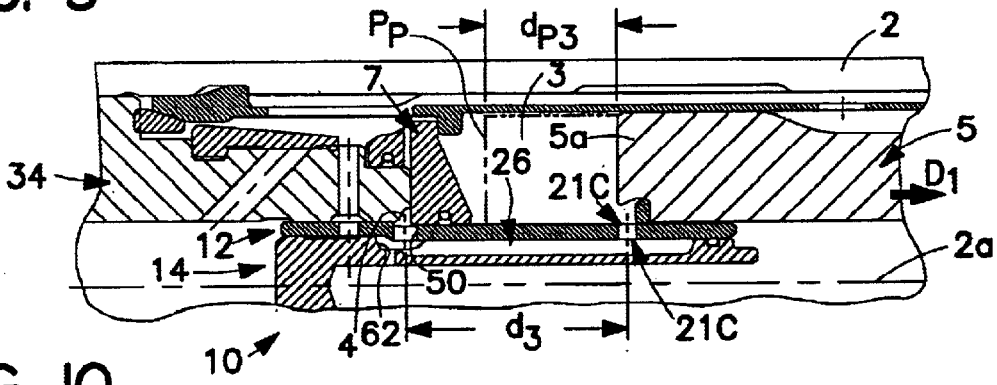
FIG. 10 is another view of the drill of FIG. 8, showing a third port of the first member fluidly connected with the second member flow passage.
Figure 11:
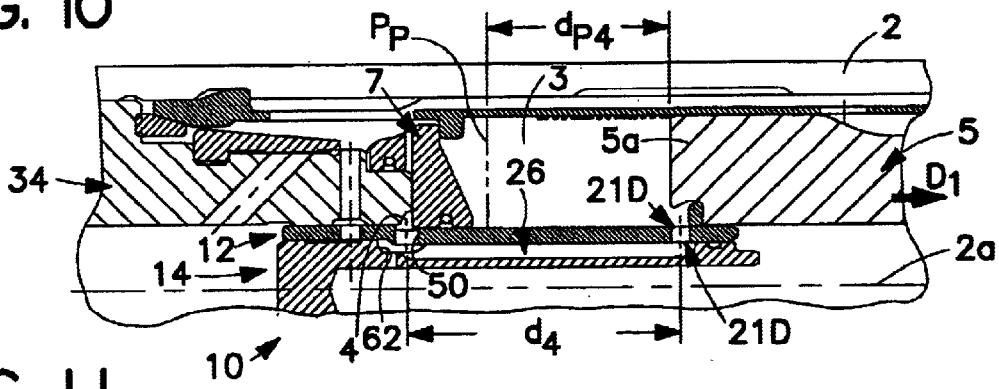
FIG. 11 is another view of the drill of FIG. 8, showing a fourth port of the first member fluidly connected with the second member flow passage.
Figure 12:
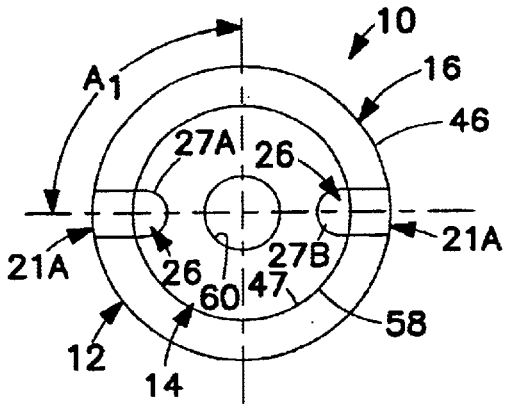
FIG. 12 is a radial cross-sectional view of the channeling device through a pair of first ports, showing the second member in a first angular position with respect to the first member.
Figure 13:
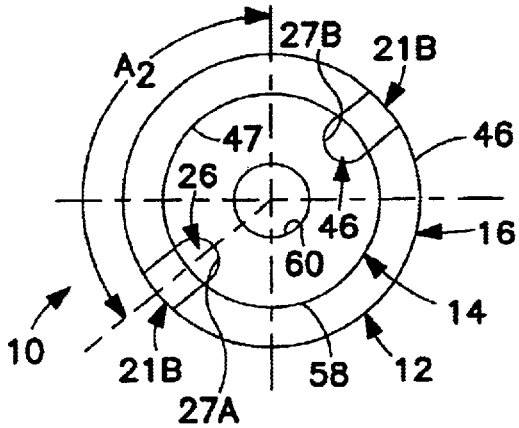
FIG. 13 is a radial cross-sectional view of the channeling device through a pair of second ports, showing the second member in a second angular position with respect to the first member.
Figure 14:
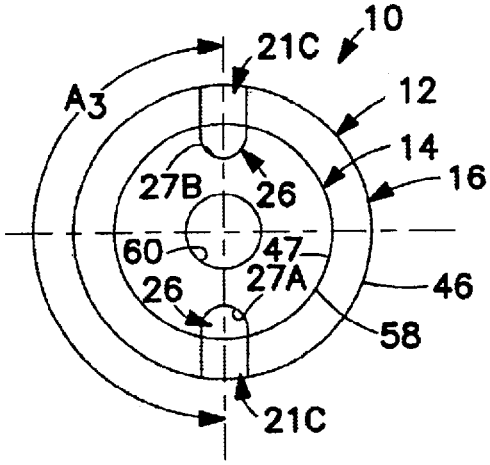
FIG. 14 is a radial cross-sectional view of the channeling device through a pair of third ports, showing the second member in a third angular position with respect to the first member.
Figure 15:
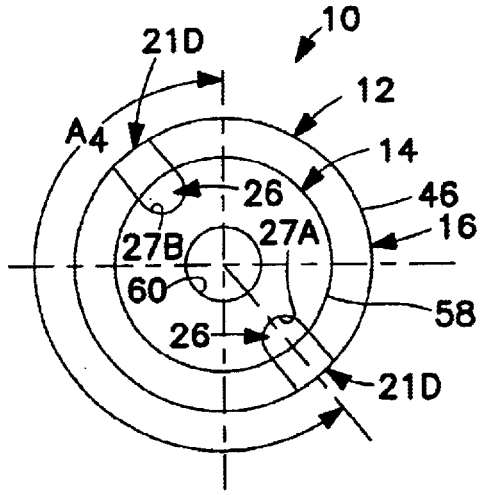
FIG. 15 is a radial cross-sectional view of the channeling device through a pair of fourth ports, showing the second member in a fourth angular position with respect to the first member.
Figure 16:
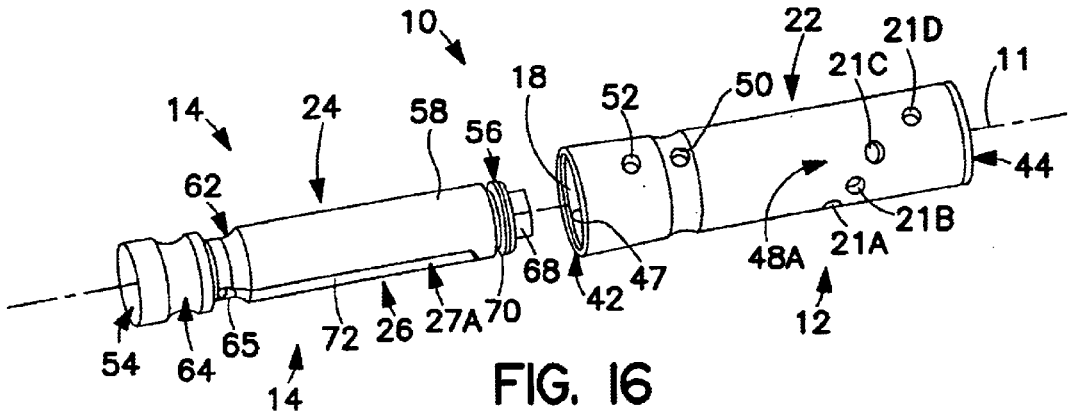
FIG. 16 is an exploded view of the channeling device, showing the second member located in the first angular position.
Figure 17:
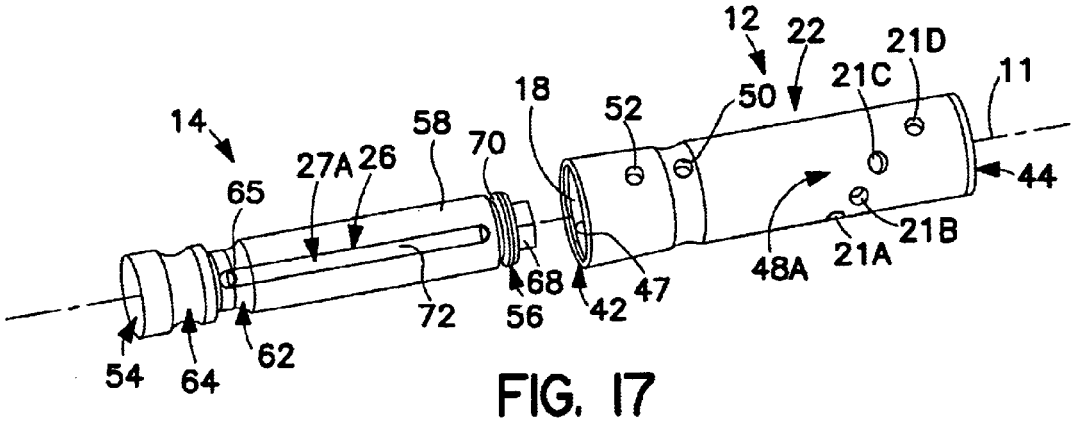
FIG. 17 is an exploded view of the channeling device, showing the second member located in the third angular position.

Referring to FIG. 10, with the structure described above, when the third ports 21C are each fluidly connected with the associated flow passage 26, the valve 7 moves to the closed position $V_c$ after the piston 5 displaces a third distance $D_{P3}$ from the proximal position $P_P$, which is greater than each of the first and second displacement distances $d_{P1}$, $d_{P2}$, respectively. Further, when the fourth ports 21D are each fluidly connected with the associated flow passage 26, as shown in FIG. 11, the valve 7 moves to the closed position $V_c$ after the piston 5 displaces a fourth distance $d_{P4}$ from the proximal position P, the fourth displacement distance $d_{P4}$ being greater than each of the respective first, second and third distances $d_{P1}$, $d_{P2}$ and $d_{P3}$. Preferably, the second member 14 may be also angularly positioned with respect to the first member 12 such that none of the ports 20 are fluidly connected or radially aligned with either of the passages 26. In such an orientation of the two member 12, 14, closure of the valve 7 does not occur until after the piston 5 displaces completely off of the fluid channeling device 10, at which point fluid flow from the drive chamber 3 to the valve chamber 4 occurs through a central bore 60 of the second member 14, as described below. Therefore, with the preferred structure of the first member 12, the point in the piston downward movement at which the valve 7 is closed may be progressively increased by utilizing the second ports 21B, the third ports 21C, the fourth ports 21D, or none of the ports 20, to fluidly connect the drive chamber 3 with the valve chamber 4.

Referring now to FIGS. 1–3 and 5–17, the second member cylindrical body 24 has a first, upper radial end 54, a second, lower radial end 56 spaced from the first end 54 along the central axis 11 and an outer circumferential surface 58. Preferably, the first and second members are relatively sized with generally equal axial length such that the first ends 42, 54 of the two members 12, 14, respectively, are generally "flush", with each other (i.e., located at about the same position with respect to the axis 11) and only a projection 68 (described below) at the second end 56 of the cylindrical body 24 extends outwardly from the first body interior space 18. Further, the outer circumferential surface 58 is configured to frictionally engage with the inner circumferential surface 47 of the first member 12 so as to retain the cylindrical body 24 disposed within the tubular body 22. Preferably, at least an upper portion 47*a* of the first member inner surface 47 and at least an upper portion 58*a* of the second member outer surface 58 are each generally conical or has inner diameter or outer diameter, respectively, that tapers along the axis 11. As such, the outer surface section 58*a* of the second, inner member 14 wedges against the inner surface section 47*a* of the first, outer member 12 so as to thereby frictionally retain the second member 14 within the first member 12 by means of a "taper lock".

In addition to the flow passage(s) 26, as discussed in further detail below, the second member 14 preferably further includes a central longitudinal through-bore 60 extending axially between the body first and second ends 54, 56, respectively. The central bore 60 functions both as part of a pressure relief flow passage, specifically to remove fluid accumulating within the valve chamber 4 when all the ports 20 are closed, and as a bypass passage to enable a portion of the fluid within the supply chamber 8 to be diverted through the channeling device 10 to flow out of the drill 1 through the piston bore 6 and the bit bore 29, as discussed below. Further, the second member 14 also includes first and second generally annular recesses 62, 64 each extending radially into the cylindrical body 24 from the outer surface 58 and completely circumferentially about the central axis 11. The flow passages 26 each intersect the first, lower or "primary" recess 62, which is radially aligned and fluidly connected with the two outlet ports 50 of the first member 12, such that fluid flows from the passage 26, into the primary recess 62 and through the outlet ports 50 to the valve chamber 4. Further, at least one and preferably two supplemental ports 65 extend generally radially between the central bore 60 and the primary recess 62, so as to fluidly connect the bore 60 with the valve chamber 4 through both the primary recess 62 and outlet ports 50.

With this structure, when the second member 14 is positioned with respect to the first member 12 such that none of the ports 20 are fluidly connected with either of the passages 26, any fluid accumulating in the valve chamber 4, due to leakage about the valve seals (not indicated), flows from the chamber 4, through the outlet ports 50, the primary recess 62 and the supplemental passage(s) 65, into the central bore 60 and thereafter through the piston and bit bores 6 and 29, respectively, and out of the drill 1. Otherwise, such fluid accumulating within the valve chamber 4 will eventually exert a sufficient pressure against the valve 7, generally in the downward direction $D_1$, so as to prevent displacement of the valve 7 to the open position $V_o$. Further, the second, upper or "bypass" annular recess 64 is disposed proximal to the first end 54 of the body 24 and is fluidly connected with the bypass ports 52 of the first member 12. The recess 64 and the bypass ports 52 provide a path to bypass fluid between the supply chamber 8 (through a passage 34a in the backhead 34) and the central bore 60 when one or more radial ports (none shown) are provided between the second recess 64 and the bore 60. As such, a portion of the fluid within the supply chamber 8 may be directed or "vented" out of the drill 1 to prevent an excessive volume of fluid from accumulating within the supply chamber 8.

Further, the second, inner member 14 also preferably includes a generally hex-shaped projection or lug 68 extending axially and outwardly from the second, lower end 56 of the cylindrical body 24. The lug 68 provides a surface for impacts by a hammer or other tool (none shown) to thereby "break" the frictional engagement between the first member inner surface section 47*a* and the second member outer surface section 58*a*. In addition, the second member 14 also preferably includes a third annular recess 70 extending radially into the cylindrical body 24 from the outer surface 58 and completely circumferentially about the central axis 11, the recess 70 being located proximal to the body second, lower end 56. An O-ring 74 is disposeable within the third recess 70 so as to fluidly seal any clearance space (not indicated) between the first and second members 12 and 14 of the channeling device 10.

Furthermore, the flow passage(s) 26 are each preferably formed as an elongated axial groove 72 extending generally radially into the second member 14 from the outer surface 58. Each groove 72 is spaced from and extends generally parallel with respect to the central axis 11, and thus extends generally axially between the body first and second ends 54, 56, respectively. Most preferably, the second member 14 includes two flow passages 26, a first flow passage 27A and a second flow passage 27B, the two passages 27A, 27B being spaced apart by about 180 degrees about the central axis 11. Each flow passage 27A, 27B is configured to interact with a separate one of the two preferred port sets 48A, 48B of the first member 12 such that, at any particular angular position $A_N$ of the second member 14 with respect to the first member 12 (or vice-versa) about the axis 11, each passage 27A, 27B is radially aligned with a separate one of the ports 20 of each corresponding pair of ports 20 (e.g., the two first ports 21A).

In other words, in a first angular position $A_1$ (FIG. 12), the first flow passage 27A is aligned with the first port 21A of the first port set 48A while the second flow passage 27B is aligned with the first port 21A of the second port set 48B. In a second angular position $A_2$ (FIG. 13), the first passage 27A is aligned with the second port 21B of the first port set 48A and the second passage 27B is simultaneously aligned with the second port 21B of the second port set 48B. Further, in a third angular position $A_3$ (FIG. 14), the first flow passage 27A is aligned with the third port 21C of the first port set 48A while the second flow passage. 27B is aligned with the third port 21C of the second port set 48B. Furthermore, in a fourth angular position $A_4$ (FIG. 15), the first passage 27A is aligned with the second port 21B of the first port set 48A and the second passage 27B is simultaneously aligned with the second port 21B of the second port set 48B. Finally, as discussed above, the second member 14 is also locatable in a fifth angular position (not depicted) with respect to the first member 12 at which neither flow passage 27A, 27B is radially aligned with any of the ports 20, such that fluid flow is substantially prevented through the two flow passages 26.

Although the fluid channeling device 10 is preferably formed as described above, it is within the scope of the present invention to form either or both of the first and second members 12, 14, respectively, in any other appropriate manner. For example, the first member 12 may include either a single port set (e.g., 48A) and the second member 14 may include only a single flow passage 26, or the first member 12 may be formed with three or more port sets and the second member 14 may be formed with a corresponding number of flow passages 26. Further for example, the first and second members 12 and 14 may be relatively sized and/or shaped in any other appropriate manner, such as forming the first member 12 as a relatively short tubular sleeve disposed about only a portion of the second member 14 or forming the second member 14 as a relatively short tubular or cylindrical body disposed within an appropriately sized internal cavity of the first member (neither alternative shown). As yet another example, the two members 12 and 14 may each have any other appropriate radial cross-sectional shape (i.e., besides circular), such as generally hexagonal or octagonal. The scope of the present invention includes these and all other appropriate constructions of the first and second members 12, 14, respectively, that enable the fluid channeling device 10 to function generally as described herein.

Prior to use, the first and second members 12 and 14 are assembled together, and then assembled into the drill 1, in the following manner. First, the second end 56 of the second member cylindrical body 24 is inserted into the first member interior space 18 through the first end 42, then the second member 12 is further displaced along the axis 11 until the second member 14 is almost completely disposed within the interior space 18. However, prior to full engagement between the interlocking surface sections 47*a*, 58*a*, the second, inner member 14 is preferably positioned with respect to the first, outer member 12 about the axis 11 in order to align the two flow passages 26 with a desired pair of control ports 20, depending on the desired timing of valve closure. Such alignment is preferably performed by viewing one of the flow passages 27A or 27B through the desired port 20 of the associated port set 48A or 48B. Alternatively, indexing marks/notches (none shown) for the passages 27A, 27B may be provided on the upper end of the second member 14 and corresponding marks/notches (none shown) may be provided on the upper end of the first member 12 to indicate the positions of the control ports 20, such that the passage marks are aligned with the marks for the desired ports 20.

The specific control ports 20 to be fluidly connected with the flow passages 26 are selected in accordance with the following general guidelines. When it is desired to have valve closure occur at an earliest point or time in the piston downward displacement, and thus reduce the total amount or volume of fluid flowing into the drive chamber 3, the first, upwardmost control ports 21A are selected. Such a setting of the fluid channeling device 10 optimizes drill performance when the drill 1 is used with a fluid supply 30 of a relatively greater or higher pressure capacity, since a desired amount or volume of fluid (e.g., compressed air) flows into the drive chamber 3 in a shorter period of time as compared with flow provided by a relatively lesser or lower pressure fluid supply 30. When it is desired to delay valve closure from the earliest point/time as discussed above, either the second ports 21B, the third ports 21C or the fourth ports 21D are selected, which progressively increases the amount of time that the valve 7 is located in the open position $V_o$. For a given pressure capacity of the fluid supply 30, a greater amount or volume of fluid will flow into the drive chamber 3 when the valve 7 remains open for a longer period of time. Thus, delaying the valve closure will enable a volume/amount of fluid to enter the drive chamber 3 that is sufficient to drive the piston 5 into the bit 28 at a desired impact force when the drill 1 is used with a fluid supply 30 of a lesser or lower pressure.

Further, the second member 14 may be oriented at an angular position (not shown) with respect to the first member 12 at which the flow passages 26 are not radially aligned with any of the control ports 20, such that the flow passages 26 are completely covered or "blocked" by portions of the tubular wall of the first member body 22. With the fluid channeling device 10 so arranged, fluid cannot flow into the passages 26, but instead a portion of the fluid in the drive chamber 3 flows into the second member central bore 60, through the supplemental ports 65 and the primary recess 62, through the first member outlet ports 50, and thereafter into the valve chamber 4. Thus, such a relative orientation of the first and second members 12, 14, respectively, results in maximum delay of valve closure and thus maximizes the volume or amount of fluid flowing from the supply chamber 8 and into the drive chamber 3.

Once the second member 14 is positioned with respect to the first member 12 at a desired one of the described orientations, the second member 14 is further displaced into the first member interior space 18 until the first, upper end 54 of the second member 14 is generally flush with the first member upper end 42 and the two inner surface sections 47*a*, 58*a* become interlocked, as discussed above. Then, the fluid channeling device 10 is inserted into the backhead bore 35 in the manner described above and is installed into the drill casing 2 as part of an assembly that includes the backhead 34, the valve 7 and another valve (not indicated) for controlling flow into the supply chamber 8. The drill 1 is then configured to operate with closure of the valve 7 occurring at a desired time/point in the piston downward displacement that is ideal for operation with the pressure capacity of a particular fluid supply 30 used with the drill 1.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as generally described herein.

We claim:

1. A fluid channeling device for a percussive drill, the drill including a casing having an interior space, a drive chamber and a valve chamber each being defined within the casing interior space, a piston movably disposed within the casing and having an upper end disposeable within the drive chamber and a longitudinal through-bore, a valve configured to control flow into the drive chamber and having a surface bounding a section of the valve chamber, the channeling device comprising:

a first member disposed at least partially within the drive chamber so as to extend into the piston bore when the piston upper end is located within the drive chamber, the first member having an outer surface, an interior space and at least one port extending between the outer surface and the interior space and fluidly connectable with the drive chamber; and a second member disposed at least partially within the first member interior space and having a passage fluidly connected with the valve chamber and fluidly connectable with the port so as to establish fluid communication between the drive chamber and the valve chamber.

2. The fluid channeling device as recited in claim 1 wherein the valve is displaceable between an open position and a closed position and when the port and the passage fluidly connect the drive chamber with the valve chamber, fluid flow into the valve chamber displaces the valve from the open position to the closed position.

3. The fluid channeling device as recited in claim 2 wherein the casing further has a longitudinal centerline and the piston is displaceable along the centerline and with respect to the fluid channeling device such that the piston substantially prevents fluid communication between the drive chamber and the port when the port is disposed within the piston bore and the port is fluidly connected with the drive chamber when the port is disposed externally of the piston bore.

4. The fluid channeling device as recited in claim 2 wherein:

the casing has a longitudinal centerline and the piston is displaceable generally along the centerline between a most proximal position with respect to the valve chamber, at which the first member is disposed at least partially within the piston bore, and a most distal position with respect to the valve chamber, at which the first member is spaced apart from the piston along the centerline;

the port is a first port and the first member further has a central axis and a second port spaced from the first port generally along the axis, one of the first and second members being angularly displaceable with respect to the other one of the first and second members such that the first port is fluidly connected with the passage in a first angular position and the second port is fluidly connected with the passage in a second angular position; and when the first port is fluidly connected with the passage, the valve moves to the closed position after the piston displaces at least a first distance from the proximal position and alternatively when the second port is fluidly connected with the passage, the valve moves to the closed position after the piston displaces at least a second distance from the proximal position, the second distance being greater than the first distance.

5. The fluid channeling device as recited in claim 1 further comprising a central axis extending longitudinally through each one of the first and second members and wherein at least one of the first and second members is angularly displaceable about the axis with respect to the other one of the first and second members so as to adjust the position of the port with respect to the passage.

6. The fluid channeling device as recited in claim 5 wherein:

the second member has an outer surface and the passage is formed as an elongated groove extending generally radially into the second member from the outer surface, the groove being spaced from and extending generally parallel with respect to the central axis; and the first member has a plurality of ports extending between the interior space and the first member outer surface, each one of the ports being spaced axially and radially about the axis from each of the other ports such that each port is fluidly connectable with the passage at a separate one of a plurality of angular positions of the first member with respect to the second member.

7. The fluid channeling device as recited in claim 6 wherein the plurality of ports are spaced apart along a generally helical line extending at least partially circumferentially about and axially along the central axis.

8. The fluid channeling device as recited in claim 5 wherein the first member has at least a first port and a second port, the first port being spaced a first distance from the valve chamber and the second port being spaced a second distance from the valve chamber, the second distance being greater than the first distance.

9. The fluid channeling device as recited in claim 1 wherein the first member includes a generally tubular body and the second member includes a generally cylindrical body portion sized to fit within the tubular body.

10. The fluid channeling device as recited in claim 9 wherein the tubular body has an inner circumferential surface and the second member cylindrical body portion has an outer circumferential surface, the inner and outer circumferential surfaces each being configured to frictionally engage with the other surface so as to retain the cylindrical body portion disposed within the tubular body.

11. The fluid channeling device as recited in claim 1 further comprising a central axis extending longitudinally through each of the first and second members and wherein the first member further includes an outlet port extending between the outer surface and the interior space and spaced apart from the port along the central axis, the outlet port being fluidly connected with the valve chamber and with the second member passage.

12. A fluid channeling device for a percussive drill, the drill including a casing having an interior space, a drive chamber and a valve chamber each being defined within the casing interior space, a piston movably disposed within the casing and having an upper end disposable within the drive chamber and a longitudinal through-bore, a valve configured to control flow into the drive chamber and having a surface bounding a section of the valve chamber, the channeling device comprising: a generally tubular body disposed at least partially within the drive chamber so as to extend into the piston bore when the piston upper end is located within the drive chamber, the first member having an outer and inner circumferential surfaces and a plurality of ports, each port extending between two surfaces and fluidly connectable with the drive chamber; and a generally cylindrical body disposed at least partially within the tubular body and having a passage fluidly connected with the valve chamber, at least one of the tubular body and the cylindrical body being angularly displaceable with respect to the other one of the tubular body and the cylindrical body such that each one of the ports is fluidly connectable with the passage at a separate angular position of the tubular body with respect to the cylindrical body so as to establish fluid communication between the drive chamber and the valve chamber.

13. The fluid channeling device as recited in claim 12 wherein the valve is displaceable between an open position and a closed position and when the port and the passage fluidly connect the drive chamber with the valve chamber, fluid flow into the valve chamber displaces the valve from the open position to the closed position.

14. The fluid channeling device as recited in claim 13 wherein:

the casing has a centerline and the piston is displaceable generally along the centerline between a most proximal position with respect to the valve chamber, at which the tubular body is disposed at least partially within the piston bore, and a most distal position with respect to the valve chamber, at which the tubular body is spaced apart from the piston along the centerline;

the fluid channeling device further comprises a central axis extending longitudinally through each one of the tubular body and the cylindrical body and generally colinearly with respect to the casing centerline, each one of the ports being spaced axially and radially about the axis from each of the other ports; and when one of the ports is fluidly connected with the passage, the valve moves to the closed position after the piston displaces a first distance from the proximal position and alternatively when another one of the ports is fluidly connected with the passage, the valve moves to the closed position after the piston displaces a second distance from the proximal position, the second distance being greater than the first distance.

15. A drill comprising:

a casing having an interior space, a drive chamber and a valve chamber each being defined within the casing interior space;

a piston movably disposed within the casing and having an upper end disposeable within the drive chamber and a longitudinal through-bore;

a valve configured to control flow into the drive chamber and having a surface bounding a section of the valve chamber;

a first member disposed at least partially within the drive chamber so as to extend into the piston bore when the piston upper end is located within the drive chamber, the first member having an outer surface, an interior space and at least one port extending between the outer surface and the interior space and fluidly connectable with the drive chamber; and a second member disposed at least partially within the first member interior space and having a passage fluidly connected with the valve chamber and fluidly connectable with the port so as to establish fluid communication between the drive chamber and the valve chamber.

16. The drill as recited in claim 15 wherein the valve is displaceable between an open position and a closed position and when the port and the passage fluidly connect the drive chamber with the valve chamber, fluid flow into the valve chamber displaces the valve from the open position to the closed position.

17. The drill as recited in claim 15 wherein:

the casing has a longitudinal centerline and the piston is displaceable generally along the centerline between a most proximal position with respect to the valve chamber, at which the first member is disposed at least partially within the piston bore, and a most distal position with respect to the valve chamber, at which the first member is spaced apart from the piston along the centerline;

the port is a first port and the first member further has a central axis and a second port spaced from the first port generally along the axis, one of the first and second members being angularly displaceable with respect to the other one of the first and second members such that the first port is fluidly connected with the passage in a first angular position and the second port is fluidly connected with the passage in a second angular position; and when the first port is fluidly connected with the passage, the valve moves to the closed position after the piston displaces at least a first distance from the proximal position and alternatively when the second port is fluidly connected with the passage, the valve moves to the closed position after the piston displaces at least a second distance from the proximal position, the second distance being greater than the first distance.

18. The drill as recited in claim 15 further comprising a central axis extending longitudinally through each one of the first and second-members and wherein at least one of the first and second members is angularly displaceable about the axis with respect to the other one of the first and second members so as to adjust the position of the port with respect to the passage.

19. The drill as recited in claim 15 wherein:

the second member has an outer surface and the passage is formed as an elongated groove extending generally radially into the second member from the outer surface, the groove being spaced from and extending generally parallel with respect to the central axis; and the first member has a plurality of ports extending between the interior space and the first member outer surface, each one of the ports being spaced axially and radially about the axis from each of the other ports such that each port is fluidly connectable with the passage at a separate one of a plurality of angular positions of the first member with respect to the second member.

20. The drill as recited in claim 15 wherein:

the first member includes a generally tubular body having an inner circumferential surface; and the second member includes a generally cylindrical body portion sized to fit within the tubular body and having an outer circumferential surface, the inner and outer circumferential surfaces each being configured to frictionally engage with the other surface so as to retain the cylindrical body portion disposed within the tubular body.

* * * * *